US005407378A

United States Patent [19]

Shank, Jr.

[11] Patent Number: 5,407,378

[45] Date of Patent: Apr. 18, 1995

[54] WATER BLASTING PROCESS

[75] Inventor: James D. Shank, Jr., Vestal, N.Y.

[73] Assignee: Church & Dwight Co., Inc., Princeton, N.J.

[21] Appl. No.: 97,062

[22] Filed: Jul. 23, 1993

[51] Int. Cl.[6] ..... B24C 5/00

[52] U.S. Cl. ..... 451/38; 451/91; 83/53; 83/177

[58] Field of Search ..... 451/38, 39, 40, 91, 451/99, 102; 83/53, 169, 177

[56] References Cited

U.S. PATENT DOCUMENTS

| | | | |
|---|---|---|---|
| 3,994,097 | 11/1976 | Lamb | 51/321 |
| 4,046,528 | 9/1977 | Liljestrand | 55/160 |
| 4,251,240 | 2/1981 | Brennan et al. | 55/168 |
| 4,583,329 | 4/1986 | Lang | 51/410 |
| 4,802,312 | 2/1989 | Glaeser et al. | 51/321 |
| 4,922,664 | 5/1990 | Spinks et al. | 51/321 |
| 5,316,587 | 5/1994 | Yam et al. | 51/307 |
| 5,317,841 | 6/1994 | Cook et al. | 51/321 |

*Primary Examiner*—Maurina T. Rachuba
*Attorney, Agent, or Firm*—Charles B. Barris

[57] ABSTRACT

Wet blasting utilizing a high pressure liquid stream to clean, cut or drill a targeted surface is provided with improved efficiency by degassing the liquid stream. Deaeration of the liquid stream reduces atomization of the high pressure stream as it exits the blast nozzle and is directed against the targeted surface so as to improve the efficiency of the stripping action and improve pump efficiency.

23 Claims, No Drawings

WATER BLASTING PROCESS

FIELD OF THE INVENTION

The present invention relates to improvements in pumping liquids to high pressure. More particularly, the invention is concerned with improvements in pumping water to high pressure for use in cutting or drilling and for wet blasting to remove adherent material such as paint, scale, dirt, grease and the like from solid surfaces.

BACKGROUND OF THE INVENTION

In order to clean a solid surface, for example, to preserve metal against deterioration, remove graffiti from stone or simply to degrease or remove dirt from a solid surface, it has become common practice to use an abrasive blasting technique wherein abrasive particles are propelled by a high pressure fluid against the solid surface in order to dislodge previously applied coatings, scale, dirt, grease or other contaminants. Such abrasive blasting has been used favorably, for example, to degrease metal and has replaced the environmentally unsafe solvent treatments.

Various abrasive blasting techniques have been used including dry blasting which involves directing the abrasive particles to a surface by means of pressurized air typically ranging from 30 to 150 psi, wet blasting in which the abrasive blast media is directed to the surface by a highly pressurized stream of water typically 3,000 psi and above, and a process in which both air and water are utilized either in combination at high pressures to propel the abrasive blast media to the surface as disclosed in U.S. Pat. No. 4,817,342, or in combination with relatively low pressure water used as a dust control agent or to control substrate damage.

The blast media or abrasive particles most widely used for blasting surfaces either by dry or wet blasting to remove adherent material therefrom is sand. Sand is a hard abrasive which is very useful in removing adherent materials such as paint, scale and other materials from metal surfaces such as steel. While sand is a most useful abrasive for each type of blasting technique, there are disadvantages in using sand as a blast media. For one, sand, i.e., silica, is friable and upon hitting a metal surface will break into minute particles which are small enough to enter the lungs. These minute silica particles pose a substantial health hazard. Additionally, much effort is needed to remove the sand from the surrounding area after completion of blasting. Still another disadvantage is the hardness of sand itself. Thus, sand cannot readily be used as an abrasive to remove coatings from relatively soft metals such as aluminum or any other soft substrate such as plastic, plastic composite structures, concrete or wood, as such relatively soft substrates can be excessively damaged by the abrasiveness of sand. Moreover, sand cannot be used around moving parts of machinery inasmuch as the sand particles can enter bearing surfaces and the like.

An alternative to sand as a blast media, particularly, for removing adherent coatings from relatively soft substrates such as softer metals as aluminum, stainless steel, composite surfaces, plastics, ceramic tile, concrete and the like is sodium bicarbonate. While sodium bicarbonate is softer than sand, it is sufficiently hard to remove coatings from metal surfaces and as well remove coatings including paint, dirt, and grease from non-metallic surfaces without harming the substrate surface. Sodium bicarbonate is not harmful to the environment and is most advantageously water soluble such that the particles which remain subsequent to blasting can be simply washed away without yielding environmental harm. Since sodium bicarbonate is water soluble and is benign to the environment, this particular blast media has found increasing use in removing coatings and cleaning dirt, grease and oil and the like from hard surfaces such as steel and interior surfaces which contact food such as in environments of food processing or handling.

Wet blasting to remove coatings and other contaminants from solid surfaces using a high pressure water stream either alone, or preferably, in conjunction with an abrasive blast media has advantages of economy over utilizing a dry blasting technique in which compressed air is used as the carrier for the blast media from the nozzle structure to the targeted surface. It is relatively easy to pump the water carrier to the high pressures utilized in the wet blasting technique. On the other hand, the compression equipment needed to compress air to even the modest pressures utilized in the dry blasting technique is quite expensive.

In order to optimize the efficiency of wet blasting for removing a coating or other contaminants from a targeted surface, it is important that the high pressure liquid stream contacting the surface remain coherent from the time the stream exits the blast nozzle to the time the stream contacts the target surface. What is meant by the term coherent is that the stream does not disperse prior to contacting the targeted surface. Dispersement of the water stream reduces the efficiency of the stripping operation since the stripping efficiency is dependent upon the mass and velocity of the high pressure liquid stream at the point of contact with the target surface. Unfortunately, in wet blasting operations, there occurs a dispersal or atomization of the liquid stream prior to contact with the targeted surface. Moreover, the atomized liquid creates a mist and can create visibility problems similar to dust formation during dry blasting operations. Poor visibility can cause the operator of the blast nozzle to continuously overlap portions of the targeted surface already stripped by contact with the high pressure liquid stream. The mist can also react unfavorably to the surrounding environment, for example create moisture problems on nearby surfaces or equipment.

It is believed that one reason for the atomization of the liquid stream as it exits the blast nozzle and prior to contact with the targeted surface is that there is a substantial amount of gas in the liquid stream. This gas escapes during travel of the stream to the targeted surface causing atomization of the liquid stream.

Dissolved gases such as air in liquid streams may also adversely affect pump efficiency, in particular, when the liquid stream is being pumped to high pressure, i.e. 1,000 psi +, such as by positive displacement piston pumps. High pressure water streams have use in blast cleaning, cutting and drilling applications where water pressures as high as 20,000 psi are useful. The dissolved gases result in cavitation, especially on the inlet stroke of the pump. Cavitation reduces pump output volume, increases power consumption and causes wear on moving parts.

Accordingly, the primary objective of the present invention is to wet blast a targeted surface for the removal of coatings or other contaminants therefrom and to maintain the abrasive liquid stream as a coherent stream as it contacts the targeted surface so as to improve stripping efficiency.

Another object of the present invention is to provide a wet blasting process to remove coatings and other contaminants from a surface and to eliminate the atomization of the high pressure liquid stream prior to contact with the targeted surface.

Still another object of the invention is to improve pump efficiency especially when pumping liquids to high pressure.

Yet another object of the present invention is to improve pump efficiency when pumping liquids and slurries.

SUMMARY OF THE INVENTION

In accordance with the present invention, a wet blasting process is provided in which a high pressure stream of liquid, particularly, water, is directed against a targeted surface in order to remove coatings and/or other contaminants therefrom. Prior to directing the liquid stream onto the target surface, the liquid stream is degassed so as to reduce atomization of the high pressure liquid stream prior to contact with the targeted surface. In a typical process of the present invention, a water stream is deaerated by conventional deaeration equipment and the deaerated water stream pumped to a high pressure. The high pressure water stream is passed through a nozzle to accelerate the stream and direct it as a coherent stream against the targeted surface to strip coatings and other contaminants therefrom. Deaeration of the water stream greatly improves the efficiency of the pumping equipment by preventing the formation of air pockets and by eliminating cavitation within the pump. The high pressure liquid streams for the wet blasting process can include water only, water with a liquid additive such as for affecting surface tension or for improving the detersive action of the blast stream, i.e., a surfactant or may be a slurry of water and a solid abrasive to enhance the stripping process.

In general, the invention is also directed to degassing any liquid or slurry stream which is to be pumped to a high pressure, i.e., 1,000 psi or above, to improve pump efficiency. Degassing such as deaeration can be achieved by a variety of means including degassing a thin film of the liquid by application of a vacuum.

DETAILED DESCRIPTION OF THE INVENTION

The wet blasting process of the present invention utilizes a high pressure liquid stream such as water to strip coatings or other contaminants from a targeted surface. The high pressure liquid stream can be liquid alone or the liquid stream may have a finely divided solid abrasive mixed therein. The liquid is preferably water although other liquids such as low viscosity polymers may be used alone or as additives to water to alter viscosity, density, surface tension, etc.

The blasting equipment used in the wet blasting process of the present invention can be any of the conventional blasting equipment presently used. Preferably, the blasting equipment comprises a venturi nozzle in which the pressurized fluid is accelerated by passage through a restricting orifice and directed to the targeted surface through an expanding outlet section of the nozzle. Typically, the venturi nozzle is a hand held device, although, automatic operation may be useful in some situations. The type of nozzle equipment used to direct the high pressure liquid stream into contact with a surface is not critical to the invention as long as such equipment is capable of producing a coherent stream of liquid. High pressure water blasting equipment can be obtained from a variety of sources including "Aqua-Dyne® High Pressure Water Jet Blaster" and "Dyna-Grit" wet abrasive blast system from Aqua-Dyne Inc., Houston, Tex., and "Aqua-Miser" blasting equipment from Carolina Equipment and Supply Co., Inc., North Charleston, S.C. such as described in U.S. Pat. No. 5,220,935 herein incorporated by reference.

In operation of the wet blasting process of this invention, water from a supply is directed to a deaeration device in which dissolved gasses are removed from the water stream. The deaerated water stream is directed to a pump which is capable of operating at pressures in excess of 1,000 psi, preferably, at least 3,000 psi and above to form a high pressure water stream. The high pressure water stream is directed to the venturi nozzle structure which accelerates the liquid stream and directs same onto the targeted surface to strip the contaminants therefrom.

In the first step of the wet blasting process and prior to pumping the liquid supply to a high pressure suitable for stripping contaminants from a surface, the liquid supply stream is degassed, e.g., deaerated. The reduction in the amount of gas in the liquid stream being directed to the targeted surface greatly reduces, if not eliminates, the extent of atomization of the high pressure liquid stream as it exits the blast nozzle. As stated previously, atomization of the liquid stream reduces the force of the water stream on the targeted surface and consequently reduces the stripping efficiency of the wet blasting technique. Atomization of the liquid stream beyond the nozzle also creates a visibility problem for the operator of the nozzle. Also, degassing the liquid stream prior to the pump importantly increases the efficiency of the pump by avoiding the formation of air pockets and cavitation of the liquid within the pump. Any known deaeration equipment can be utilized. This includes equipment which takes advantage of the density differences between the gas and the liquid. In such equipment, the liquid is made to make a rapid change in flow direction so as to segregate the less dense gaseous material. Centrifugal separation is an example of such a deaerator in which the liquid stream is directed in a spiral or vortex motion in which the gases escape through the central axis of the vortex. The preferred deaerating equipment directs a liquid stream over a flat or corrugated surface in an enclosed environment to increase the exposed surface area of the liquid stream while simultaneously applying a vacuum against the liquid film which is formed on the surface. Heating the liquid stream to a temperature of about 30° to 75° C. improves the deaeration efficiency. Sparging the liquid with a light gas such as $CO_2$ prior to deaeration can also be used to improve the rate of deaeration. The light gas carries the dissolved gases out of the liquid. The type of deaeration equipment utilized is not critical to the invention and any such known devices can be used. Deaeration equipment utilized in the food industry to remove air from beverages may be well suited for deaeration in the present invention. Thus, vacuum-type deaeration equipment from GEA Food and Process System Corp., Columbia, Md. and APV Rosista, Inc., Rockford, Ill., can be used.

In the wet blasting process, the high pressure liquid stream may comprise liquid only, in particular, water. Other liquids for the high pressure stream can be used besides water such as materials which increase specific gravity and/or reduce water viscosity such as water soluble resins although the expense of such materials may be prohibitive in a wet blasting process. The water stream may include additives in minor amounts to improve the flow of the water through the blasting equipment or to improve the stripping process or may even include additives which provide a post-treatment onto the targeted surface. For example, the water stream may include as an additive detersive agents such as surfactants to enhance the removal of the contaminants from the targeted surface. Post-treatment agents which can be added to the water stream include sanitizers, rust-proofing agents, etc. which beneficially treat the targeted surface subsequent to the removal of the contaminants therefrom.

The high pressure liquid stream may also be mixed with abrasive particles to enhance the stripping or cutting action of the blast stream. The particulate abrasive typically utilized with the high pressure liquid stream for wet blasting is sand. However, to reduce clean-up costs, reduce harm to the environment and health, it is preferred to use water soluble abrasive particles with the high pressure liquid stream which preferably is water. The abrasive particles typically will be in the form of a powder containing substantially singular particles having an average size range of from about 10 to 1,000 microns in diameter. Preferably, the abrasive particles will have an average size of from about 50–500 microns. Water soluble abrasive particles are advantageous since such blast media can be readily disposed of by a water stream, are readily separated from the insoluble paints and resins which have been stripped to facilitate waste disposal, and since most water soluble blast media are relatively soft, i.e., Mohs hardness less than 3.0, such media can be utilized to remove coatings, grease, dirt and the like from a variety of substrates including hard surfaces such as steel as well as relatively soft metals such as aluminum and stainless steel as well as plastic, ceramic, concrete, wood and composites of such materials. Water soluble blast media having a Mohs hardness of less than 5.0 are generally useful in this invention, in particular, for cleaning softer substrates.

Non-limiting examples of water soluble blast media which can be utilized include the alkali metal and alkaline earth metal salts such as the chlorides, chlorates, carbonates, bicarbonates, sulfates, silicates, the hydrates of the above, etc. The preferred abrasive particles are the alkali metal salts and, in particular, the sodium and potassium carbonates, bicarbonates and sulfates. The most preferred blast media to be incorporated into the high pressure water stream are the alkali metal bicarbonates as exemplified by sodium bicarbonate. Also preferably useful are sodium sesquicarbonate, natural sodium sesquicarbonate known as trona, sodium bicarbonate, sodium carbonate, potassium carbonate, potassium bicarbonate, sodium chloride and sodium sulfate which is described in commonly assigned U.S. Pat. No. 5,112,406. It is important to note that by water soluble is not meant completely water soluble as some salts and natural minerals such as trona may contain minor amounts of insoluble materials. For example, trona which is a natural sodium sesquicarbonate may contain up to 10 wt. % of insolubles. Thus, by water soluble is meant to include those materials which are substantially soluble in water.

If abrasive particles are added to the liquid stream, the addition can be achieved by a variety of ways. For example, the abrasive particles can be added to the liquid stream by aspiration, by means of compressed air or by mixture in a slurry. Subsequent to the addition of the abrasive particles, the liquid stream containing the abrasive particles can be degassed by the various known techniques described above and then pumped by conventional slurry pumps into the high pressure liquid stream capable of stripping a targeted surface. Although not preferred, it is possible to add the abrasive particles to the degassed high pressure stream prior to or at the blast nozzle. However, methods of mixing the abrasive particles into the liquid stream such as by aspiration at the nozzle or injection by compressed air, may add dissolved gasses back into the liquid stream, negating the prior degassing process at least with respect to avoiding atomization of the liquid stream and consequent visibility problems. Equipment which does not add air into the water stream along with the abrasive particles should be used if the abrasive particles are to be added subsequent to pumping the water to high pressure. Accordingly, it is preferred to add the abrasive particles to the liquid supply stream and then degas the formed slurry. Importantly, deaerating subsequent to addition of the abrasive particles improves the wetting of the particles in the liquid stream by removing minute gas bubbles which are trapped on the surface of the abrasive particles.

If water soluble abrasive particles are mixed with the water stream to enhance contaminant removal from the targeted surface, it is been found advantageous to avoid dissolution of the abrasive particles prior to contact with the targeted surface. Dissolution of the water soluble abrasive particles is avoided by saturating the water stream with the abrasive and then forming a slurry of additional solid abrasive in the saturated water stream. The slurry of solid water-soluble abrasive and saturated solution of the abrasive can be deaerated, pumped and accelerated through the blast nozzle without excessive dissolution of the abrasive particles. Commonly assigned, copending application D-23693 discloses wet blasting with slurries of solid water-soluble abrasives in saturated aqueous solutions and the advantages thereof in maintaining the mass and cutting edges of the particulate abrasive. The contents of this copending application are herein incorporated by reference. Thus, any liquid stream which contains water soluble particles including the primary high pressure liquid stream or any secondary liquid stream which carries the particles of abrasive to the primary carrier stream should be a saturated solution so as to avoid the dissolution of the particles which may result in a decrease in cutting efficiency of the particles.

Often, blast cleaning with water soluble abrasive particles in water will result in a water soluble residue remaining on the targeted surface. To reduce residues of the blast media from remaining on the substrate surface, the blast media can include a surfactant incorporated therein. The surfactant which may be utilized can be anionic, nonionic or amphoteric in nature or mixtures of the various types of surfactant can be used. The surfactant can be added to the abrasive particles or to the water carrier streams. Commonly assigned, copending U.S. application Ser. Nos. 006,658 and 006,659, both filed Jan. 21, 1993, describe the types of surfactants which can be added to abrasive blast media particles to reduce residue formation and how such surfactants can be added to the media and are herein incorporated by reference.

The amount of surfactant needed to provide reduced residue content and easily rinsed residues is extremely small in most cases and, thus, will range from about finite levels to about 3 wt. %, preferably about 0.05 to about 1 wt. %, and, more preferably, from about 0.05 to 0.5 wt. % of the abrasive blast media particles. It has further been found that the addition of the surfactant can actually aid in removing any dirt, grease or oil from the substrate. Nonionic surfactants appear to best provide the additional detersive action. Thus, it may be possible to provide several kinds of surfactants with the blast media including those most readily able to reduce residue formation such as anionic surfactants and those capable of enhancing the removal of dirt, grease or oil from the substrate. The surfactant advantageously solubilizes the dirt and grease allowing easier clean up and reduces the deflection of dirt from one surface to another. Surfactant additives may be able to reduce abrasive levels and even eliminate the need for abrasive addition altogether on substrates or contaminants which have previously required particulate abrasive treatment for cleaning or removal, respectively.

While the present invention has been described as useful in a wet blasting process to remove contaminants from a targeted surface with a high pressure liquid stream, the invention has as its broadest aspect degassing or deaerating any high pressure liquid stream. Thus, as stated previously, deaerating a water stream which is to be pumped to a high pressure of at least 1,000 psi, more particularly, 3,000 psi, or still higher to pressures of at least 10,000 psi up to about 20,000 psi, can increase pump efficiency. Thus, air or other gas in the liquid may cause cavitation during pumping, in particular, on the inlet stroke of a positive displacement pump. The cavitation reduces the pump output volume, increases the power consumption and may cause the pump to wear on the moving parts. Thus, while deaeration of a liquid stream used as a blast stream in wet blasting has advantages in eliminating or greatly reducing atomization of the liquid stream as it is directed toward a targeted surface, any process which involves pumping a liquid stream to high pressure can be provided with advantages in pump efficiency by degassing. Thus, processes of pumping liquid streams such as water to a high pressure such as for cutting, drilling or blasting can be improved by the process of prior deaeration or degassing in general as in the present invention.

EXAMPLE

The following wet blasting system is useful in removing any type of contaminant from a targeted surface. The water blasting equipment utilized is an "Aqua-Miser" water blaster from Carolina Equipment and Supply Co. and is a water blaster which has a rotating nozzle head within the scope of the U.S. Pat. No. 5,220,935. The water is pressurized to 15,000 psi and flows from the nozzle tip at 3 gallons per minute. Prior to pumping, one half to two pounds per minute of Armex® sodium bicarbonate blast media from Church and Dwight Co. and having an average diameter of 150 microns is added to the water stream to form a slurry. The slurry is directed to a deaerator which comprises a 25 gallon capacity tank which has a flat baffle at top onto which the slurry is directed. The slurry spreads over the top of the baffle and over the edge of the baffle as a flowing curtain to the bottom of the deaeration tank. A vacuum of 26 to 29.5 inches of mercury is pulled in the deaerator such as by a Stokes liquid ring vacuum pump. Subsequent to deaeration, the slurry is pumped to high pressure and directed from the "Aqua-Miser" water blasting nozzle to the targeted surface for contaminant removal.

What is claimed is:

1. In a process for blasting wherein a liquid supply stream is pumped to a high pressure liquid stream, said high pressure liquid stream is directed to a blast nozzle to accelerate said high pressure stream and said accelerated high pressure stream is directed from said blast nozzle to a target surface, the improvement comprising:

degassing said liquid supply stream prior to pumping said liquid supply stream to high pressure.

2. The process of claim 1 wherein said high pressure liquid stream is formed by pumping said liquid supply stream to a high pressure of at least about 1,000 psi.

3. The process of claim 2 wherein said high pressure liquid stream is formed by pumping said liquid supply stream to a high pressure of at least about 3,000 psi.

4. The process of claim 1 wherein said liquid supply stream is water.

5. The process of claim 3 wherein said liquid supply stream is water.

6. The process of claim 1 wherein said degassing is achieved by subjecting said liquid supply stream to a vacuum.

7. The process of claim 1 wherein said degassing is achieved by sparging said liquid supply stream with a lighter gas which carries dissolved gases from said liquid stream.

8. The process of claim 7 wherein subsequent to said sparging the liquid supply stream is subjected to a vacuum.

9. The process of claim 8 wherein said liquid supply stream is water and said degassing removes air from the water stream.

10. The process of claim 9 wherein said lighter gas is $CO_2$.

11. The process of claim 1 wherein said high pressure liquid stream contains abrasive particles.

12. The process of claim 11 wherein said abrasive particles are water soluble and said high pressure liquid stream is water.

13. The process of claim 12 wherein said water soluble abrasive particles comprise sodium bicarbonate.

14. The process of claim 11 wherein said abrasive particles are added to said liquid supply stream prior to said pumping.

15. The process of claim 11 wherein said particles are added to said high pressure stream.

16. The process of claim 1 wherein said blasting comprises blast cleaning wherein a contaminant is removed from said target surface.

17. The process of claim 1 wherein said blasting comprises cutting wherein said target surface is cut by said accelerated high pressure stream.

18. The process of claim 1 wherein said blasting is drilling wherein a hole is formed in said target surface.

19. The process of claim 1 wherein said target surface is metal.

20. The process of claim 1 wherein said target surface is non-metallic.

21. The process of claim 1 wherein said blast nozzle is hand operated.

22. The process of claim 4 wherein a liquid additive is included in said water stream to change the viscosity, specific gravity or surface tension of water.

23. The process of claim 22 wherein said additive is a surfactant.

* * * * *